US009220384B2

(12) United States Patent
Misumi et al.

(10) Patent No.: US 9,220,384 B2
(45) Date of Patent: Dec. 29, 2015

(54) SUCTION TOOL FOR VACUUM CLEANER

(75) Inventors: Naho Misumi, Tokyo (JP); Junichiro Hoshizaki, Tokyo (JP); Tsuyoshi Maeda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 429 days.

(21) Appl. No.: 13/578,512

(22) PCT Filed: Mar. 28, 2011

(86) PCT No.: PCT/JP2011/057548

§ 371 (c)(1),
(2), (4) Date: Aug. 10, 2012

(87) PCT Pub. No.: WO2011/125580

PCT Pub. Date: Oct. 13, 2011

(65) Prior Publication Data

US 2013/0042429 A1 Feb. 21, 2013

(30) Foreign Application Priority Data

Mar. 31, 2010 (JP) ..... 2010-081593

(51) Int. Cl.

| | |
|---|---|
| ***A47L 9/04*** | (2006.01) |
| ***A46B 13/00*** | (2006.01) |
| ***A46B 13/02*** | (2006.01) |
| ***A46B 17/06*** | (2006.01) |

(52) U.S. Cl.

CPC ..... *A47L 9/04* (2013.01); *A46B 13/006* (2013.01); *A46B 13/02* (2013.01); *A46B 17/06* (2013.01); *A47L 9/0455* (2013.01)

(58) Field of Classification Search

CPC ..... A47L 9/0477; A47L 9/0411; A47L 5/30; A47L 9/04; A47L 5/34; A47L 9/02

USPC ..... 15/381, 382, 383, 384, 386, 390, 392, 15/48

See application file for complete search history.

(56) References Cited

U.S. PATENT DOCUMENTS

| | | | | |
|---|---|---|---|---|
| 3,863,285 | A * | 2/1975 | Hukuba | 15/48 |
| 2004/0117942 | A1* | 6/2004 | Roney | 15/390 |

FOREIGN PATENT DOCUMENTS

| | | |
|---|---|---|
| JP | U-62-116918 | 7/1987 |
| JP | A-62-217930 | 9/1987 |

(Continued)

OTHER PUBLICATIONS

Office Action dated Jul. 30, 2014 issued in corresponding CN patent application No. 201180016287.1 (and partial English translation).

(Continued)

*Primary Examiner* — Robert Scruggs
(74) *Attorney, Agent, or Firm* — Posz Law Group, PLC

(57) ABSTRACT

There is provided a suction tool for a vacuum cleaner that can easily remove dust entangled around a rotating brush with a small force in a sanitary manner with clean hands without spreading dust.

The suction tool includes dust removing means 39 for removing dust adhering to a rotating brush 30, the dust removing means 39 includes a first remover that has substantially the same shape as a trough 34 between cleaning bodies 33 or between cleaning body holding portions 32 of the rotating brush 30, and is guided in an axial direction of the rotating brush 30 within the trough 34.

17 Claims, 7 Drawing Sheets

(56) References Cited

FOREIGN PATENT DOCUMENTS

| | | |
|---|---|---|
| JP | A-2004-135809 | 5/2004 |
| JP | A-2008-259718 | 10/2008 |

OTHER PUBLICATIONS

International Preliminary Report on Patentability dated Oct. 23, 2012, and the Written Opinion of the International Searching Authority dated Jul. 26, 2011 of PCT/JP2011/0057548 (and English translation).

Office Action dated Apr. 26, 2013 in the corresponding Taiwanese patent application No. 10220531280 (partial English translation).

JP Office Action dated Feb. 7, 2012 in priority JP Patent Application No. 2010-081593 of PCT Application No. PCT/JP2011/057548 (and English translation).

International Search Report dated Jul. 26, 2011 of PCT Application No. PCT/JP2011/057548.

* cited by examiner

SUCTION TOOL FOR VACUUM CLEANER

CROSS REFERENCE TO RELATED APPLICATIONS

This application is a U.S. national stage application of PCT/JP2011/057548 filed on Mar. 28, 2011, and claims priority to, and incorporates by reference, Japanese Patent Application No. 2010-081593 filed on Mar. 31, 2010.

TECHNICAL FIELD

The present invention relates to a vacuum cleaner including a suction tool in which a rotating brush is provided, and more particularly to a vacuum cleaner in which dust or the like adhering to the rotating brush can be removed.

BACKGROUND ART

A rotating brush is mounted to a suction tool for a vacuum cleaner, and the rotating brush rotates to scrape up dust on a surface to be cleaned rearward to be sucked. If hair or thread is entangled around the rotating brush, the rotating brush does not function.

To solve such a problem, a vacuum cleaner has been proposed in which a rotating brush is first removed from a suction tool, and ring-shaped dust removing means provided on an outer periphery of the rotating brush is slid in an axial direction (longitudinal direction) of the rotating brush, then a guide of the dust removing means is guided in a spiral groove in a hollow base and slid in the axial direction (longitudinal direction) of the rotating brush, and thus a cutter blade provided in the dust removing means is spirally moved in contact with the groove in the axial direction (longitudinal direction) of the rotating brush to remove thread-like dust (for example, see Patent Literature 1).

A vacuum cleaner also has been proposed in which a rotating brush removable by axial movement is provided in a suction tool, dust removing means is provided in a rotating brush passing portion in a bulkhead that partitions the suction tool, the rotating brush is pulled out, and thus the dust removing means rubs against a brush portion to scrape off thread, hair, or lint entangled around the brush portion (for example, see Patent Literature 2).

CITATION LIST

Patent Literature

Patent Literature 1: Japanese Patent Laid-Open No. 2008-259718 (page 7, FIG. 10)

Patent Literature 2: Japanese Patent Laid-Open No. 62-217930 (page 2, FIG. 5)

SUMMARY OF INVENTION

Technical Problem

For the suction tool for the vacuum cleaner described in Patent Literature 1, the rotating brush is removed to remove dust, and thus when the dust removing means is slid, the dust may be spread or directly touched by hand, which is not sanitary. Also, the cutter blade provided in the dust removing means may be touched, which is not safe.

For the suction tool for the vacuum cleaner described in Patent Literature 2, the dust removing means is brush bristles, and bent in a pull-out direction in removal. Thus, the dust flows out of the suction tool, or the rotating brush is pulled in an unstable manner to increase a pull-out force.

The present invention is made to solve the problem as described above, and has an object to provide a suction tool for a vacuum cleaner that can easily remove dust entangled around a rotating brush with a small force in a sanitary manner with clean hands without spreading dust.

Solution to Problem

A suction tool for a vacuum cleaner of the invention comprises a rotating brush having a cleaning body held via a cleaning body holding portion on a cylindrical base, a suction chamber having an opening in a lower part, and rotatably housing the rotating brush, driving means for rotationally driving the rotating brush, and dust removing means for removing dust adhering to the rotating brush. The dust removing means includes a first remover that is guided in an axial direction of the rotating brush within a gap and a second remover that comes into contact with a tip of the cleaning body. The dust removing means has substantially the same shape as a cross-sectional shape of a gap between cleaning bodies or between cleaning body holding portions of the rotating brush.

Advantageous Effects of Invention

According to the present invention, with the first remover and the second remover of the dust removing means, dust entangled around the rotating brush can be reliably removed in a sanitary manner with clean hands without spreading dust. Also, the first remover is guided in the axial direction of the rotating brush within a gap, and thus dust can be removed.

DESCRIPTION OF EMBODIMENTS

First Embodiment

Without Remover Protrusion

Figure 1:
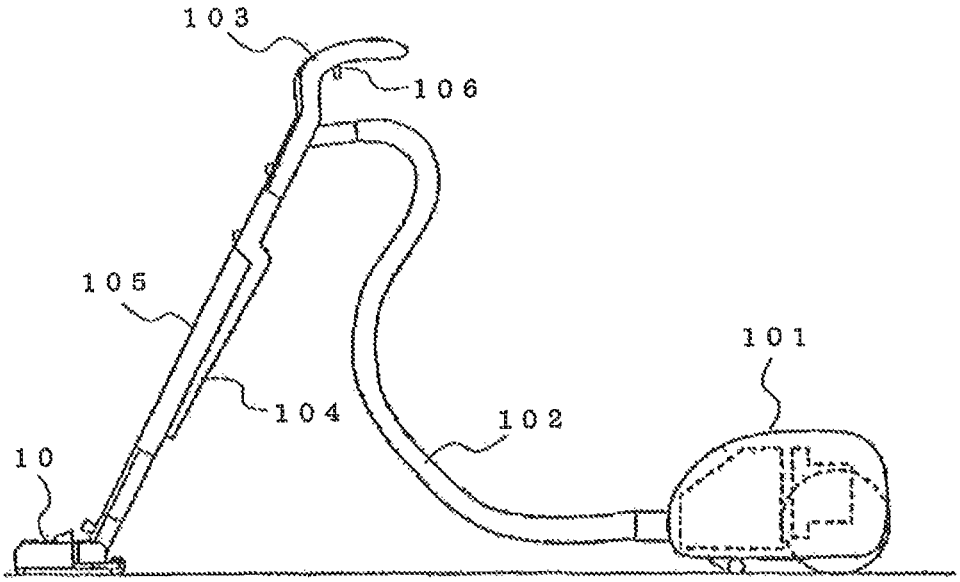
FIG. 1 is a schematic side view showing an entire configuration of a vacuum cleaner in a first embodiment according to the present invention.

FIG. 1 is a schematic side view showing an entire configuration of a vacuum cleaner in a first embodiment according to the present invention.

The vacuum cleaner includes a cleaner body 101 including an electric air blower, a control circuit, a dust collecting filter, and the like, a hose 102 having one end removably connected to a suction port of the cleaner body 101, a handle portion 103 having a switch operation portion and provided at the other can of the hose 102, an attachment body portion 104 such as a crevice nozzle provided in a branching manner at a tip of the handle portion 103, an extension pipe 105 having one end removably connected to the other branch connection port of the handle portion 103 via an on-off valve, and a suction tool 10 to which the other end of the extension pipe 105 is removably connected. A trigger 106 for removing the extension pipe 105 is provided in a lower part of the handle portion 103.

The attachment body portion 104 does not need to be provided at the end of the handle portion 103, and only an extension pipe 105 of a generally used type may be removably connected to the end. The extension pipe 105 may be of a telescopic type with a telescopic pipe, or a joint pipe type with a plurality of pipes joined.

Figure 2:
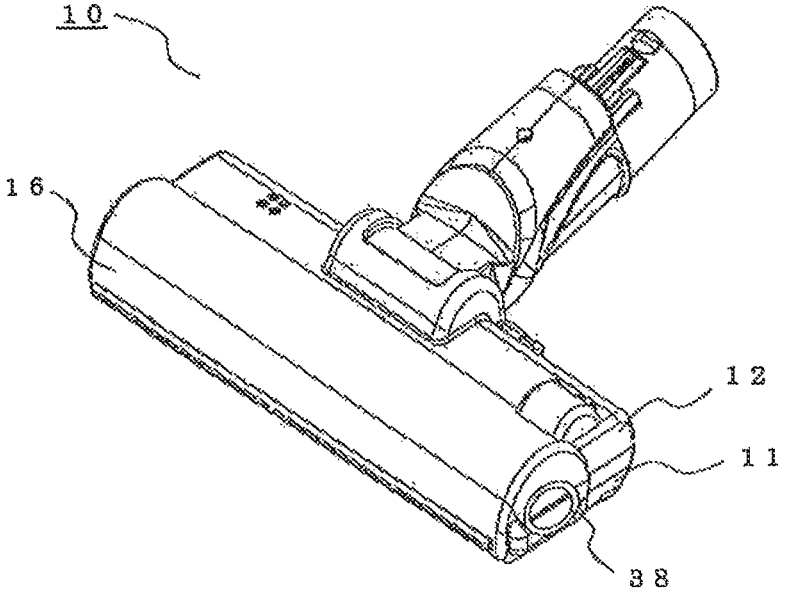
FIG. 2 is a perspective view showing a suction tool for the vacuum cleaner in the first embodiment seen from obliquely upward.
Figure 3:
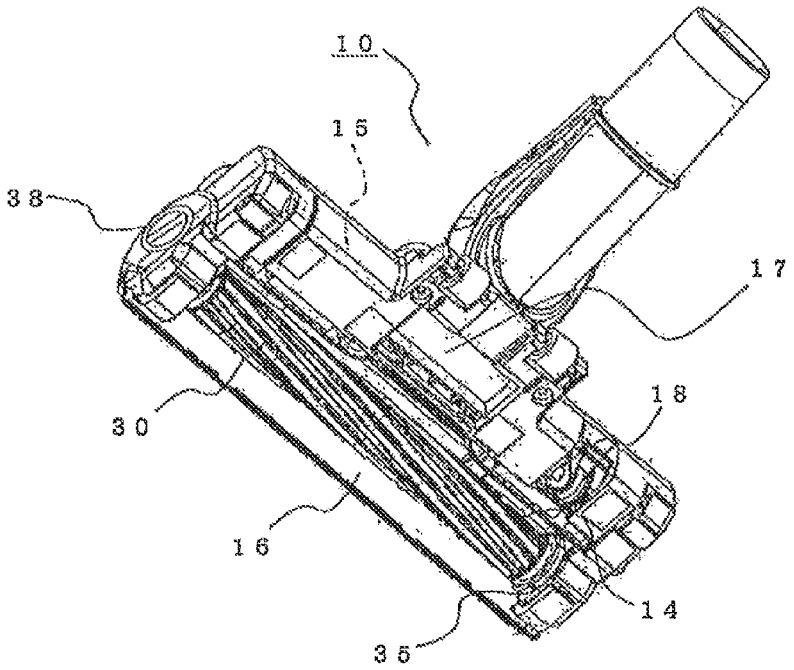
FIG. 3 is a perspective view showing the suction tool in FIG. 2 seen from obliquely downward.
Figure 4:
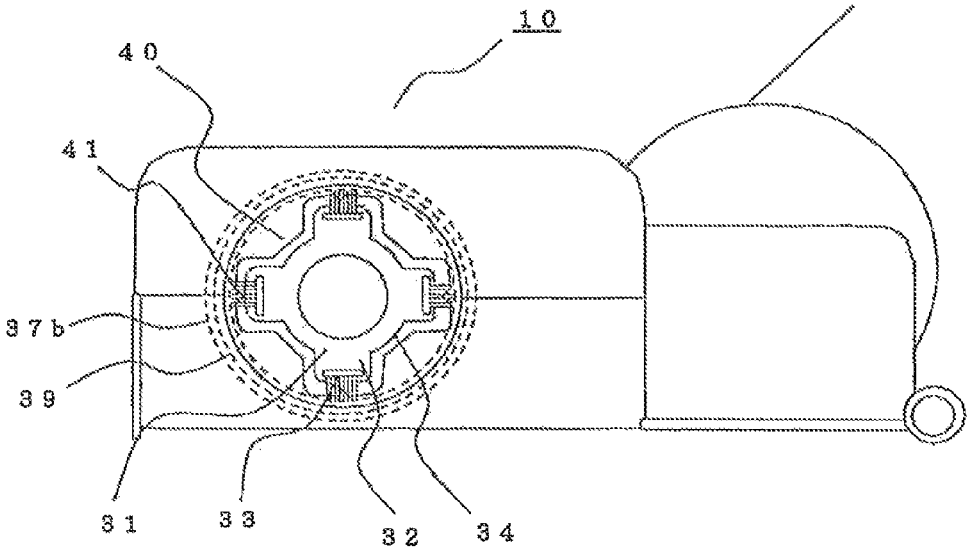
FIG. 4 is a schematic sectional view showing the suction tool for the vacuum cleaner in the first embodiment.
Figure 5:
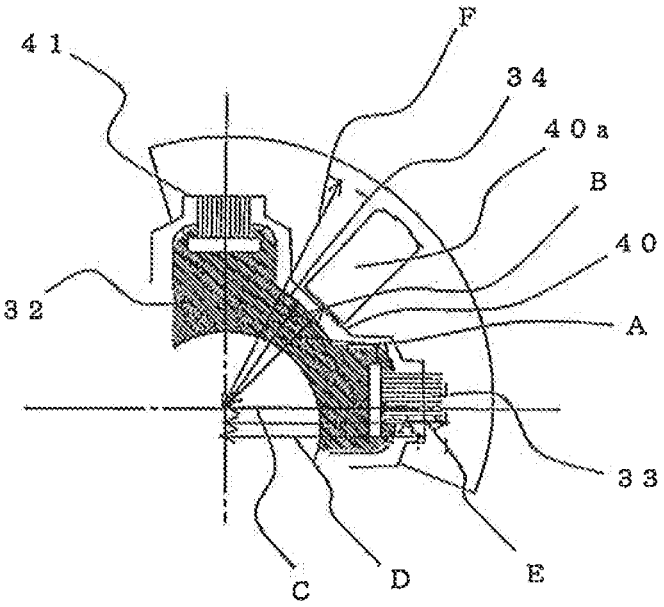
FIG. 5 is an enlarged sectional view showing dust removing means and therearound in FIG. 4.
Figure 6:
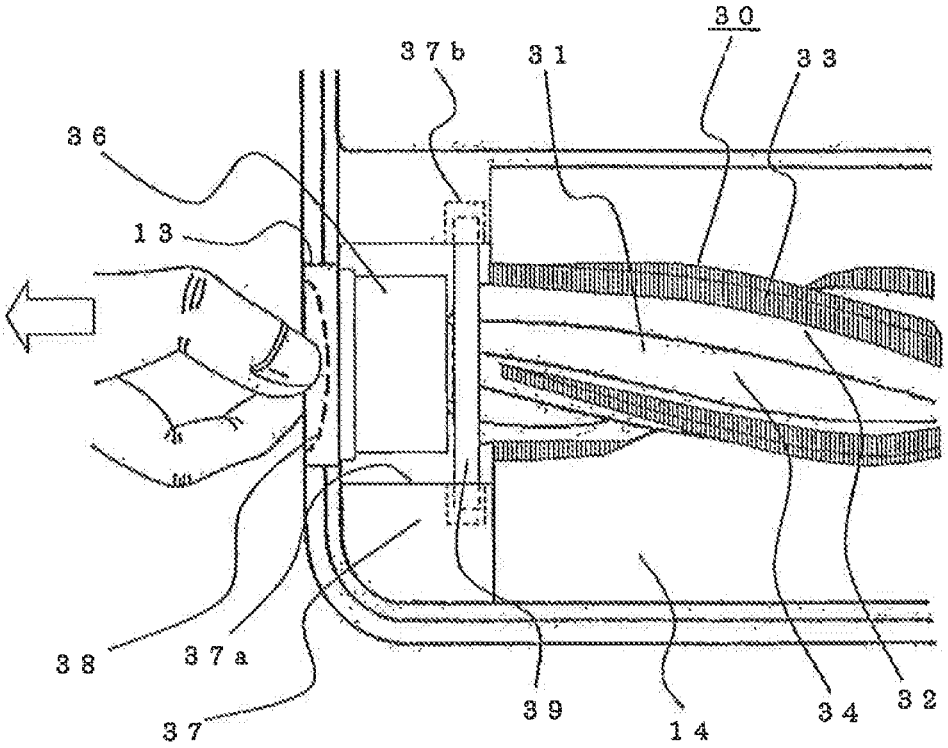
FIG. 6 is an enlarged plan view showing the dust removing means and therearound provided in the suction tool in FIG. 3.

FIG. 2 is a perspective view showing a suction tool for the vacuum cleaner in the first embodiment seen from obliquely upward. FIG. 3 is a perspective view showing the suction tool in FIG. 2 seen from obliquely downward. FIG. 4 is a schematic sectional view showing the suction tool for the vacuum cleaner in the first embodiment, FIG. 5 is an enlarged sectional view showing dust removing means and therearound in FIG. 4, FIG. 6 is an enlarged plan view showing the dust removing means and therearound provided in the suction tool in FIG. 3.

The suction tool 10 has an appearance formed by a combination of a lower case 11 and an upper case 12, and includes a suction chamber 14 having a horizontally long air duct. The suction chamber 14 rotatably houses a rotating brush 30. The rotating brush 30 has one end rotatably supported by a bearing 35 and the other end rotatably supported by a rotating brush holding portion 36, and is rotationally driven by a motor (or a turbine) that is driving means provided in the suction tool 10. The motor is provided in a region 15 in FIG. 3. A drive force of the motor is transferred, for example, via a belt to the rotating brush 30 to rotate the rotating brush 30 in a predetermined direction. An opening of the suction chamber 14 is provided in a bottom of the suction tool 10, and a buffer portion 16 made of a soft material (for example, elastomer or vinyl chloride) that is relatively easily deformed is formed in a lower part of a front surface side of the suction tool 10. A suction port 17 connected to the extension pipe 105 in FIG. 1 is provided in a rear surface side of the suction tool 10. The suction port 17 communicates with the suction chamber 14.

A wheel 18 supported by a support member (not shown) is provided on a bottom on a side of the suction port 17 in the suction tool 10. The support member is pivotably mounted to the suction tool 10 so that the wheel 18 protrudes toward a floor surface side when the suction tool 10 is raised from the floor surface, and retracts inside the suction tool 10 when the suction tool 10 is placed on the floor. The suction tool 10 includes a switch (not shown) that is turned on when the wheel 18 is retracted, and the switch is turned on to bring the cleaner body 101 (see FIG. 1) into a drivable state.

The rotating brush 30 includes a cylindrical base 31, four integrally-molded cleaning body holding portions 32 protruding from an outer peripheral surface of the cylindrical base 31, and spirally twisted in an axial direction so as to substantially cover the entire circumference of the cylindrical base 31, and cleaning bodies 33 held by the cleaning body holding portions 32 and protruding from tips thereof. A spiral trough 34 is formed between the cleaning body holding portions 32. The cleaning body holding portion 32 may be provided inside the cylindrical base 31 so that the cylindrical base 31 has a circular section externally (not shown). With such a configuration, the cleaning bodies 33 protrude from an outer peripheral surface of the cylindrical base 31. As the cleaning body 33, fibrous brush bristles or a blade made of a soft material may be used. The cleaning body 33 may be brush bristles with a combination thereof. Cleaning body holding portions 32 integrally molded on the outer peripheral surface of the cylindrical base 31 may be linearly formed in the axial direction. The number of the cleaning body holding portions is not limited to four, but at least two cleaning body holding portions may be provided.

A brush removing grip 38 is provided at one end of the rotating brush 30, one end of the brush removing grip 38 is connected to the cylindrical base 31 by a shaft (not shown), and a rotating portion (not shown) including a bearing (not shown) therein rotatably holds the cylindrical base 31. A knob **38*b*** that can be held by fingers is formed in a straight line on an opposite side surface.

An opening 13 is provided in a side wall on a side of the rotating brush holding portion 36 among side walls formed by the combination of the lower case 11 and the upper case 12 of the suction tool 10. The brush removing grip 38 is inserted into the opening 13, and the knob **38*b* is held by the side wall in which the opening 13 is formed. On the side wall side with the opening 13, a bulkhead 37 is provided as shown in FIG. 6. The rotating brush holding portion 36 as a through hole around an axis of the rotating brush 30 is provided in the bulkhead 37. A groove 37*b* is provided in an inner peripheral surface of the bulkhead 37 on a side of the suction chamber 14 of the rotating brush holding portion 36. The rotating portion (not shown) of the brush removing grip 38 is placed in the rotating brush holding portion 36, and a peripheral edge of dust removing means 39 is rotatably fitted in the groove 37*b*. When the knob 38*b* is pulled forward, the rotating portion 38*b* of the brush removing grip 38 is pulled out of the opening 13, and then the rotatably supported rotating brush 30** is pulled out.

As shown in FIG. 4, the dust removing means 39 has, for example, a circular outer shape, and an outer diameter thereof is smaller than a diameter of a bottom surface of the groove **37*a* in the bulkhead 37. The dust removing means 39 has a substantially cross-shaped hole around an axis of the rotating brush 30. In the hole, a protruding first remover 40 having substantially the same shape as the trough 34 provided between the cleaning body holding portions 32 of the cylindrical base 31, and a recessed second remover 41 having substantially the same shape as the cleaning body holding portion 32 are provided. The first remover 40 protrudes toward the center correspondingly to the trough 34. Now, with reference to FIG. 5, the shape of the hole in the dust removing means 39 will be described using a distance from the center of rotation axis of the rotating brush 30. A distance A between a lower surface of the first remover 40 and the rotation axis of the rotating brush 30 is larger than a radius of the trough 34 of the cylindrical base 31, and smaller than a distance C between the cleaning body holding portion 32 and the rotation axis of the rotating brush 30. Also, a distance D between a lower surface of the second remover 41 and the rotation axis of the rotating brush 30 is smaller than a distance between a tip of the cleaning body 33 and the rotation axis of the rotating brush 30 so as to be in contact with the cleaning body 33 of the brush bristles. Specifically, the rotating brush 30 is sized to pass through the substantially cross-shaped hole formed in the dust removing means 39. The second remover 41 has a triangular protrusion seen in the axial direction. This is provided for scraping off dust or the like adhering to the cleaning body 33**.

Next, an operation of the suction tool 10 will be described.

When the switch operation portion provided in the handle portion 103 is operated to drive the electric air blower in the cleaner body 101, dust or the like on a floor surface is sucked with air into the suction chamber 14 of the suction tool 10, and sucked from the suction port 17 in the suction tool 10 through the extension pipe 105 and the hose 102 into the cleaner body 101 (see FIG. 1). At this time, the rotating brush 30 rotates, and the dust removing means 39 also rotates with the rotating brush 30. Dust or the like scraped off by the rotation of the rotating brush 30 is also sucked. When the dust or the like is scraped up by the rotation of the rotating brush 30, lint, fibrous dust, hair, or the like is entangled and tightly twisted around the rotating brush 30. In such a state, dust, lint, or the like may adhere to the tip of the cleaning body 33 in a clump and sometimes cannot be removed.

In such a case, after cleaning of the floor surface, the switch operation portion is used to turn off power, and the brush removing grip 38 is pulled out of the suction tool 10 in the axial direction of the rotating brush 30. Then, the rotating brush holding portion 36 is pulled out of the opening 13, and then the rotating brush 30 is pulled out. At this time, the first remover 40 of the dust removing means 39 scrapes off dust or the like twisted around and adhering to the rotating brush 30, and the dust drops from the opening of the suction chamber 14 to the floor surface in the suction tool 10. Simultaneously, the second remover 41 scrapes off a dump of dust or the like adhering to the cleaning body 33 in the suction tool 10. When the switch operation portion is used to again turn on the power, the dust or the like scraped off in the suction tool 10 is sucked with air and sucked into the cleaner body 101.

The dust removing operation may be performed without turning off the power. In this case, dust is sucked simultaneously with pulling of the rotating brush 30, thereby preventing the dust or the like adhering to the rotating brush 30 from spreading outside the suction tool 10. This is more sanitary.

As described above, according to the first embodiment, the first remover 40 of the dust removing means 39 can easily remove lint, hair, or the like entangled around the rotating brush 30 with clean hand. The shape of the first remover 40 allows the rotating brush 30 to be pulled out along the side surfaces of the cleaning body holding portion 32 and the cleaning body 33, which serve as guides. Thus, the rotating brush 30 can be easily pulled out straight in a pull-out direction (axial direction of the rotating brush 30), thereby reducing a pull-out force. If the power is turned on when the brush removing grip 38 is used to pull out the rotating brush 30, the adhering dust does not flow out around the suction tool 10, which is sanitary.

Similarly, the second remover 41 allows a clump of dust or the like adhering to the cleaning body 33 to be easily removed with clean hand. When the brush removing grip 38 is held to pull out the rotating brush 30, the rotating brush 30 is rotated and pulled out by the spiral cleaning body holding portion 32. Thus, when the cleaning body 33 passes through the dust removing means 39, the cleaning body 33 comes into contact with the second remover 41 in a complicated manner, thereby more effectively removing dust.

In the first embodiment, the second remover 41 at least comes into contact with the cleaning body 33, but an amount of overlap between the second remover 41 and the cleaning body 33 may be increased. With increasing amount of overlap between the bottom surface of the second remover 41 and the cleaning body 33, the pull-out force is increased, but a force to scrape the adhering dust is increased.

Figure 7:
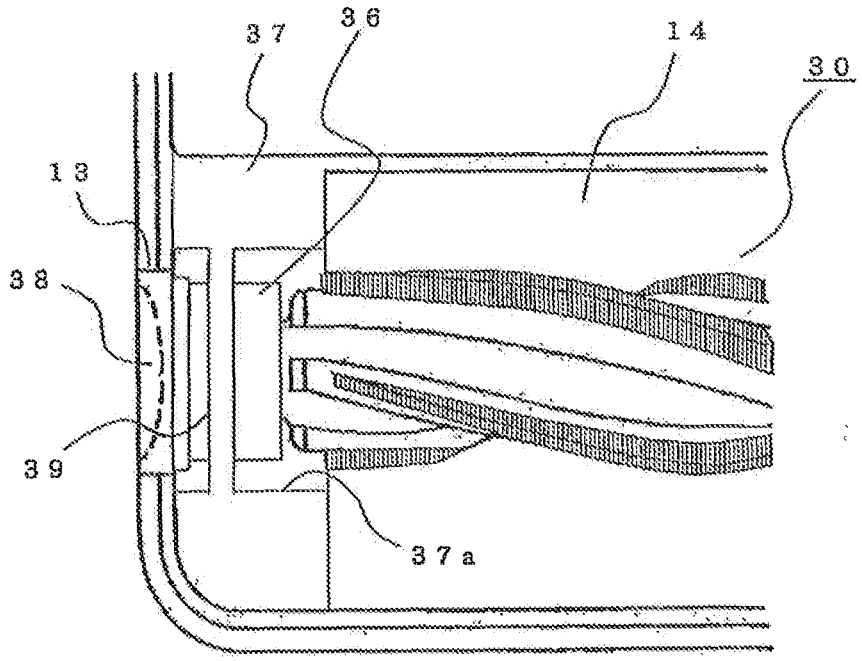
FIG. 7 is a plan view showing another example in the first embodiment.

In the first embodiment, it is described that the dust removing means 39 is rotatably mounted to the bulkhead 37, but as shown in FIG. 7, the dust removing means 39 may be formed integrally with the suction tool 10 so that the rotating brush 30 can be pulled out. With such a configuration, the dust removing means 39 does not rotate with the rotating brush 30 in operation of the cleaner body 101, thereby preventing wear of a peripheral edge of the dust removing means 39 by rotation, and reducing the number of components. Also, the dust removing means 39 may be separately configured and fixed to the bulkhead 37. In this case, the same advantage can be obtained, and a shape of a mold can be simplified although the number of components is increased.

Second Embodiment

Protrusion Type Remover

Figure 8:
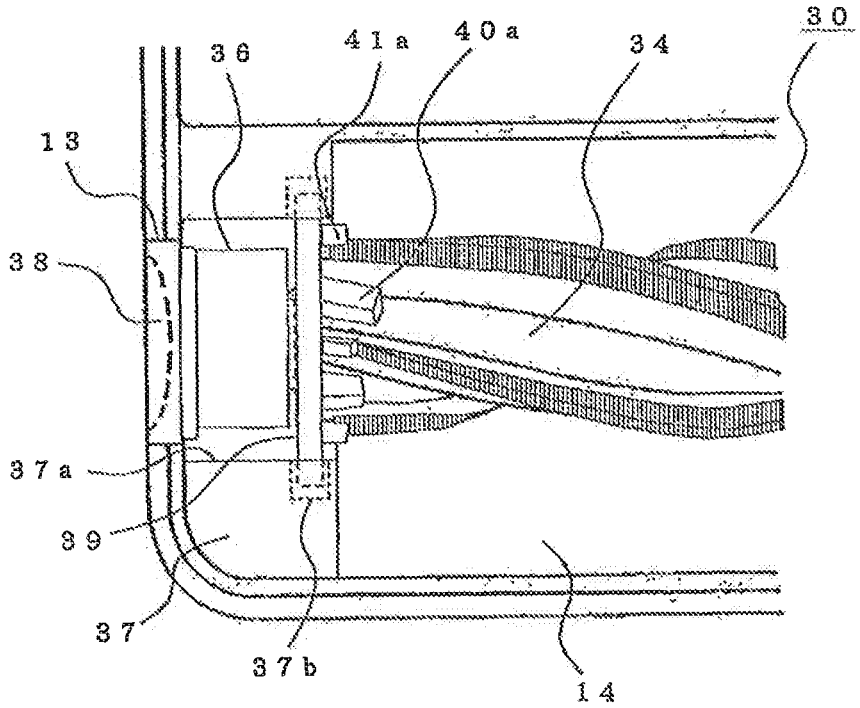
FIG. 8 is an enlarged plan view showing dust removing means and therearound of a rotating brush of a vacuum cleaner in a second embodiment according to the present invention.

FIG. 8 is an enlarged plan view showing dust removing means and therearound of a rotating brush of a vacuum cleaner in a second embodiment according to the present invention.

In the second embodiment, the first remover 40 of the dust removing means 39 in FIG. 4*a* is provided with a protrusion 40*a*, and the second remover 41 is provided with a protrusion 41*a*. The protrusion 40*a* of the first remover 40 is placed correspondingly to the trough 34 of the rotating brush 30, and extends in an axial direction of the rotating brush 30. The protrusion 40*a* has a tetragonal planar shape. The protrusion 41*a* of the second remover 41 is placed correspondingly to the cleaning body 33 of the rotating brush 30, and extends in the axial direction of the rotating brush 30. The protrusion 41*a* has a planar shape having substantially the same width at a root and a tip, and has a tetragonal section.

In the second embodiment, the rotating brush 30 is pulled out, and thus the first remover 40 can easily remove lint, hair, or the like entangled around the rotating brush 30 with clean hand. The protrusion 40*a* of the first remover 40 allows adhering dust to be removed on a more inner side of the suction tool 10, thereby preventing the adhering dust from flowing out around the suction tool 10. The shape of the protrusion 40*a* allows the rotating brush 30 to be pulled out along a side surface (trough 34) of a cleaning body holding portion 32, which serves as a guide. Thus, the rotating brush 30 can be more easily pulled out straight in a pull-out direction (axial direction of the rotating brush 30) than in the case without the protrusion, thereby reducing a pull-out force.

Similarly, the second remover 41 allows a clump of dust or the like adhering to the cleaning body 33 to be easily removed with clean hand. In the first embodiment, the amount of overlap between the bottom surface of the second remover 41 and the cleaning body 33 is increased in order to increase a scraping force of the second remover 41, while in the second embodiment, the protrusion 41*a* of the second remover 41 can scrape the adhering dust. Thus, a bottom surface of the protrusion 41*a* is sized to at least come into contact with the cleaning body 33, thereby increasing dust removing performance with a small pull-out force.

As shown in FIG. 8, the dust removing means 39 is rotatably provided in the groove 37*b* in the bulkhead 37, and thus the protrusion 40*a* of the first remover 40 is configured to easily fit in the trough 34 in the axial direction of the rotating brush 30, and the protrusion 41*a* of the second remover 41 is aligned with the cleaning body 33. Thus, when a dust removing operation of the rotating brush 30 is started, the rotating brush 30 can be pulled out without being caught by the dust removing means 39.

Figure 9:
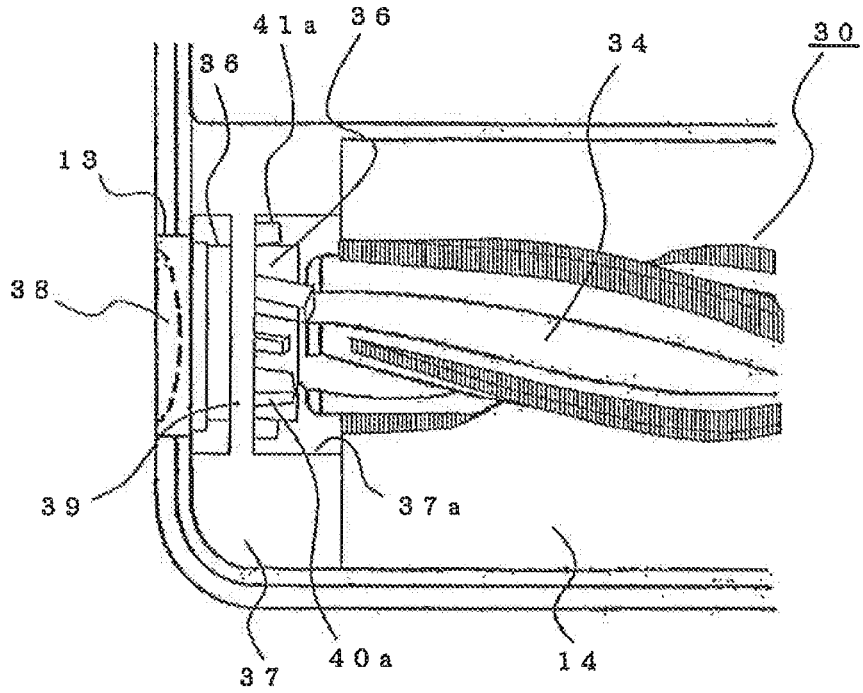
FIG. 9 is a plan view showing another example in the second embodiment.

In the second embodiment, it is described that the dust removing means 39 is rotatably mounted to the bulkhead 37, but as shown in FIG. 9, the dust removing means 39 may be formed integrally with the suction tool 10 so that the rotating brush 30 can be pulled out. With such a configuration, the dust removing means 39 does not rotate with the rotating brush 30 in operation of the cleaner body 101, thereby preventing wear of a peripheral edge of the dust removing means 39 by rotation, and reducing the number of components. Also, the dust removing means 39 may be separately configured and fixed to the bulkhead 37. In this case, the same advantage can be obtained, and a shape of a mold can be simplified although the number of components is increased.

Third Embodiment

Inclined Protrusion Type Remover

Figure 10:
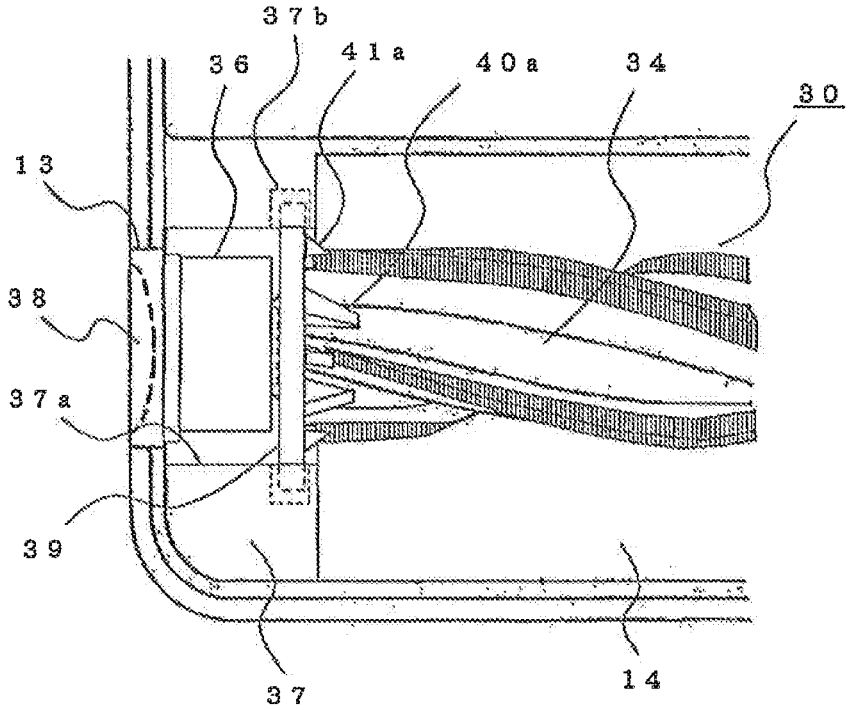
FIG. 10 is an enlarged plan view showing dust removing means and therearound of a rotating brush of a vacuum cleaner in a third embodiment according to the present invention.

FIG. 10 is an enlarged plan view showing dust removing means and therearound of a rotating brush of a vacuum cleaner in a third embodiment according to the present invention.

In the third embodiment, the first remover 40 of the dust removing means 39 in FIG. 6 is provided with a protrusion 40*a*, and the second remover 41 is provided with a protrusion 41*a*. The protrusion 40*a* of the first remover 40 is placed correspondingly to the trough 34 of the rotating brush 30, has a side surface shape with a flat surface on a side of the trough 34 of the rotating brush 30 so as to substantially come into contact with the trough gap 34 and a triangular shape inclined downward from a root toward a tip. A distance F between a root of the first remover 40, that is, a root of the protrusion 40*a* and a rotation axis of the rotating brush 30 in FIG. 5 is larger than a distance 1) between a lower surface of the second remover 41 and the rotation axis of the rotating brush 30. The protrusion 41*a* of the second remover 41 is placed correspondingly to the cleaning body 33 of the rotating brush 30, has a planar shape having substantially the same width at a root and a tip, and has a side surface shape with a flat surface on a side of the cleaning body 33 of the rotating brush 30 and a triangular shape inclined downward from the root toward the tip.

In the third embodiment, the first remover 40 can easily remove lint, hair, or the like entangled around the rotating brush 30 with clean hand. Since the protrusion 40*a* of the first remover 40 has the inclined protrusion shape (triangular shape), the twisted dust slides along the protrusion 40*a* to increase a twisting diameter (distance F) thereof, which is larger than the distance D between the lower surface of the second remover 41 of the dust removing means 39 and the rotation axis of the rotating brush 30. This can prevent the twisted dust from resisting passage of the cleaning body 33 through the dust removing means 39, and eliminates the need to increase a pull-out force.

Similarly, the second remover 41 allows a clump of dust or the like adhering to the cleaning body 33 to be easily removed with clean hand. Since the protrusion 41*a* of the second remover 41 has the inclined protrusion shape (triangular shape), the adhering dust can be removed on a more inner side of the suction tool 10, thereby preventing the dust from flowing out around the suction tool 10. Further, the protrusion 41*a* having the triangular side surface can reduce resistance against the cleaning body 33, thereby reducing the pull-out force.

As shown in FIG. 10, the dust removing means 39 is rotatably provided in the groove 37*b* in the bulkhead 37, and thus the protrusion 40*a* of the first remover 40 is configured to easily fit in the trough 34 in the axial direction of the rotating brush 30, and the protrusion 41.*a* of the second remover 41 is aligned with the cleaning body 33. Thus, when a dust removing operation of the rotating brush 30 is started, the rotating brush 30 can be pulled out without being caught by the dust removing means 39.

A height of the root of the protrusion 41*a* of the second remover 41 is smaller than a height of the root of the protrusion 40*a* of the first remover 40. Thus, when the rotating brush 30 is pulled out, the twisted dust is not pulled to increase the diameter, or the cleaning body 33, the twisted dust, and the protrusion 41*a* do not increase the resistance to increase the pull-out force, thereby reducing the pull-out force.

Figure 11:
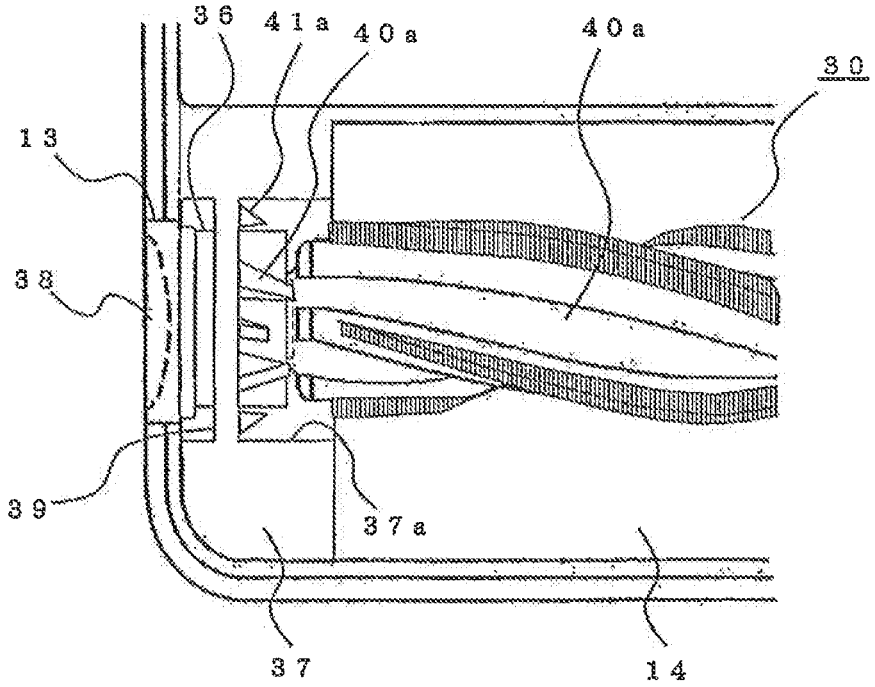
FIG. 11 is a plan view showing another example in the third embodiment.

In the third embodiment, it is described that the dust removing means 39 is rotatably mounted to the bulkhead 37, but as shown in FIG. 11, the dust removing means 39 may be formed integrally with the suction tool 10 so that the rotating brush 30 can be pulled out. With such a configuration, the dust removing means 39 does not rotate with the rotating brush 30 in operation of the cleaner body 101, thereby preventing wear of a peripheral edge of the dust removing means 39 by rotation, and reducing the number of components. Also, the dust removing means 39 may be separately configured and fixed to the bulkhead 37. In this case, the same advantage can be obtained, and a shape of a mold can be simplified although the number of components is increased.

Fourth Embodiment

Inclined Protrusion Conical Type Remover

Figure 12:
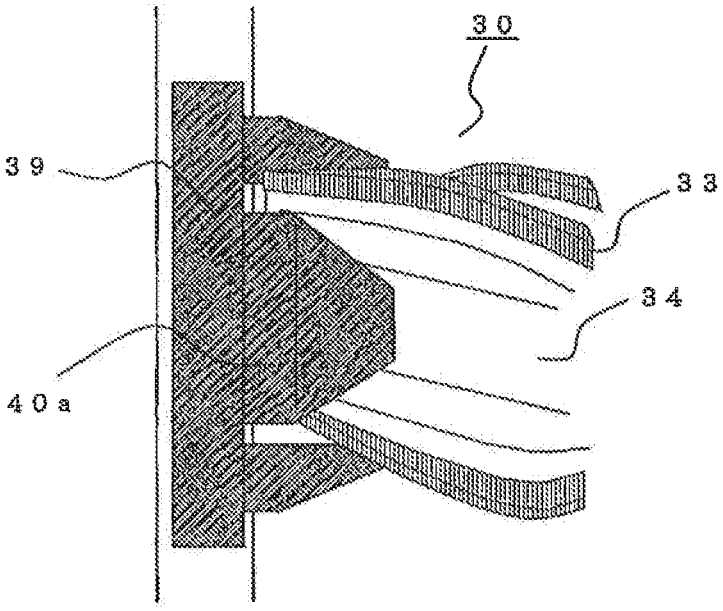
FIG. 12 is an enlarged plan view showing another example in a fourth embodiment.

FIG. 12 is an enlarged plan view showing dust removing means and therearound of a rotating brush of a vacuum cleaner in a fourth embodiment according to the present invention.

In the forth embodiment, as shown in FIG. 12, a protrusion 40*a* of the first remover 40 is placed correspondingly to the trough 34 of the rotating brush 30, has a surface in contact with the rotating brush 30 with a certain space from a surface forming from the trough 34 to the cleaning body holding portion 32 of the rotating brush 30, and has a side surface shape vertically protruding in an axial direction of the rotating brush 30 from a root toward a tip and then inclined downward in a triangular shape, and an outer peripheral surface of four protrusions 40*a* has a conical shape around the rotation axis. A distance F between a root of the first remover 40 and the rotation axis of the rotating brush 30 is larger than a distance D between a lower surface of the second remover 41 and the rotation axis of the rotating brush 30. The protrusion 41*a* of the second remover 41 is placed correspondingly to the cleaning body 33 of the rotating brush 30, has a planar shape having substantially the same width at a root and a tip, and has a side surface shape with a flat surface on a side of the cleaning body 33 of the rotating brush 30 and a triangular shape inclined downward from the root toward the tip.

In the fourth embodiment, the first remover 40 can easily remove lint, hair, or the like entangled around the rotating brush 30 with clean hand. Since the protrusion 40*a* of the first remover 40 has the conical protrusion shape (triangular shape), the adhering dust can be removed on a more inner side of the suction tool 10, and further, the twisted dust slides along the protrusion 40*a* to increase a twisting diameter thereof, which is larger than the distance D between the lower surface of the second remover 41 of the dust removing means 39 and the rotation axis of the rotating brush 30. This can prevent the twisted dust from resisting passage of the cleaning body 33 through the dust removing means 39, and eliminates the need to increase a pull-out force. Also, since the protrusion 40*a* vertically protrudes from the root, the twisted dust can be held inside the suction tool 10, thereby preventing the removed dust from flowing outside, and allowing the removed dust to be easily sucked into the body.

Similarly, the second remover 41 allows a clump of dust or the like adhering to the cleaning body 33 to be easily removed with clean hand. Since the protrusion 41*a* of the second remover 41 has the inclined protrusion shape (triangular shape), the adhering dust can be removed on a more inner side of the suction tool 10, thereby preventing the dust from flowing out around the suction tool 10. Further, the protrusion 41*a* having the triangular side surface can reduce resistance against the cleaning body 33, thereby reducing the pull-out three.

The dust removing means 39 is rotatably provided in the groove 37*b* in the bulkhead 37, and thus the protrusion 40*a* of the first remover 40 is configured to easily fit in the trough 34 in the axial direction of the rotating brush 30, and the protrusion 41*a* of the second remover 41 is aligned with the cleaning body 33. Thus, when a dust removing operation of the rotating brush 30 is started, the rotating brush 30 can be pulled out without being caught by the dust removing means 39.

A height of the root of the protrusion 41*a* of the second remover 41 is smaller than a height of the root of the protrusion 40*a* of the first remover 40. Thus, when the rotating brush 30 is pulled out, the twisted dust is not pulled to increase the diameter, or the cleaning body 33, the twisted dust, and the protrusion 41*a* do not increase the resistance to increase the pull-out force, thereby reducing the pull-out force.

In the fourth embodiment, it is described that the dust removing means 39 is rotatably mounted to the bulkhead 37, but as shown in FIG. 11, the dust removing means 39 may be formed integrally with the suction tool 10 so that the rotating brush 30 can be pulled out. With such a configuration, the dust removing means 39 does not rotate with the rotating brush 30 in operation of the cleaner body 101, thereby preventing wear of a peripheral edge of the dust removing means 39 by rotation, and reducing the number of components. Also, the dust removing means 39 may be separately configured and fixed to the bulkhead 37. In this case, the same advantage can be obtained, and a shape of a mold can be simplified although the number of components is increased.

Fifth Embodiment

Figure 13:
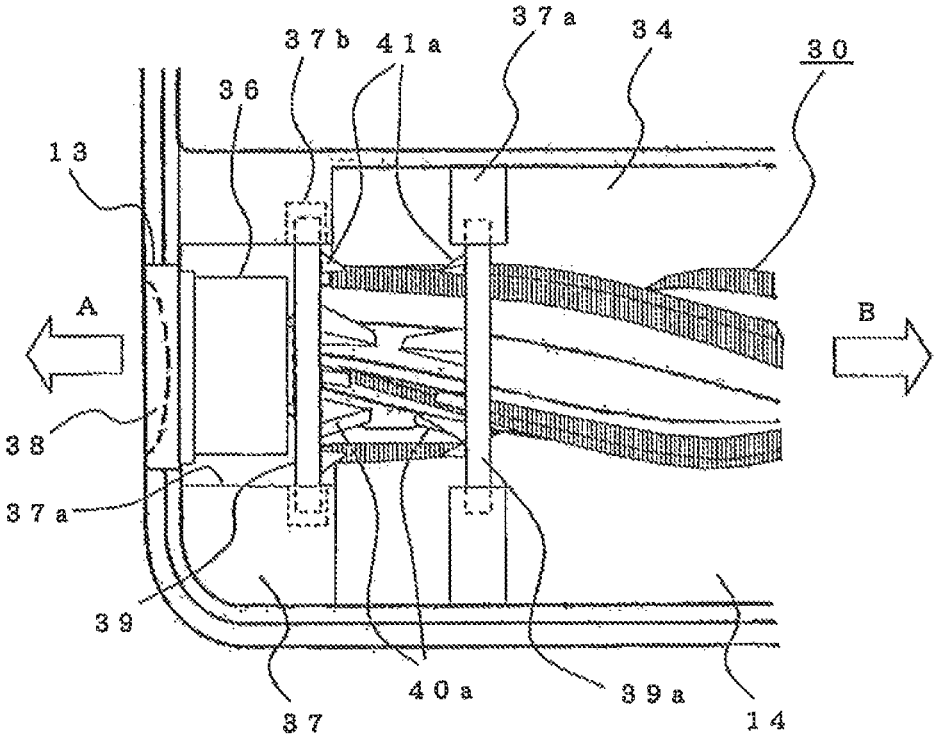
FIG. 13 is an enlarged plan view showing dust removing means and therearound of a rotating brush of a vacuum cleaner in a fifth embodiment according to the present invention.

FIG. 13 is an enlarged plan view showing dust removing means and therearound of a rotating brush of a vacuum cleaner in a fifth embodiment according to the present invention.

In the fourth embodiment, a bulkhead 37*a* and dust removing means 39*a* are added to the third embodiment in FIG. 9. As shown in FIG. 11, the bulkhead 37*a* having a through hole is provided in the suction chamber 14, the dust removing means 39*a* is mounted to the bulkhead 37*a*, protrusions 40*a* of first removers 40 of dust removing means 39 and 39*a* face each other, and protrusions 41*a* of second removers 41 face each other.

In the fourth embodiment, when the rotating brush 30 is pulled out in a direction of arrow A, the dust removing means 39 removes adhering dust, and when the rotating brush 30 is returned in a direction of arrow B, the dust removing means 39*a* removes adhering dust. This reciprocation can more reliably remove dust adhering to the rotating brush 30. Since the adhering dust accumulates between the dust removing means 39 and the dust removing means 39*a*, the dust removed from the rotating brush 30 can be easily disposed of or sucked by the cleaner body 101.

In the first to fifth embodiments described above, it is described that the dust removing means 39 is used in the rotating brush 30 including the four cleaning body holding portions 32 spirally wound in the axial direction around the outer peripheral surface of the cylindrical base 31, but not limited to this. For example, the dust removing means may be used in a rotating brush 30 including a cleaning body 33 protruding from an outer peripheral surface of a cylindrical base 31. In this case, a first remover of the dust removing means has substantially the same shape as a trough gap provided between cleaning bodies.

Also, it is described that the dust removing means 39 is applied to the rotating brush 30 including the four cleaning bodies 33 spirally wound in the axial direction of the cylindrical base 31, but it goes without saying that the dust removing means 39 may be applied to a rotating brush including a cleaning body 33 provided linearly in the axial direction of the cylindrical base 31.

INDUSTRIAL APPLICABILITY

The present invention described above with the embodiments can be widely used as a vacuum cleaner with easy and sanitary maintenance.

| Reference Signs List |
|---|
| 10 suction tool, 11 lower case, 12 upper case, 13 opening, 14 suction chamber, 16 buffer portion, 17 suction port, 18 wheel, 30 rotating brush, 31 cylindrical base, 32 cleaning body holding portion, 33 cleaning body, 34 trough, 35 bearing, 36 rotating brush holding portion, 37 bulkhead, 38 brush removing grip, 39 dust removing means, 40 first remover, 40a protrusion, 41 second remover, 41a protrusion, 101 cleaner body, 102 hose, 103 handle portion, 104 attachment body portion, 105 extension pipe |

The invention claimed is:

1. A suction tool for a vacuum cleaner comprising:

a rotating brush having a cleaning body held via a cleaning body holding portion on a cylindrical base;

a suction chamber having an opening in a lower part, and rotatably housing the rotating brush;

a driving device for rotationally driving the rotating brush; and a dust removing device for removing dust adhering to the rotating brush, wherein the dust removing device includes a first remover that has substantially the same shape as a trough between cleaning bodies or between cleaning body holding portions of the rotating brush, and is guided in an axial direction of the rotating brush within the trough, wherein the first remover includes a protrusion placed correspondingly to the trough, wherein the protrusion of the first remover has a side surface shape with a flat surface on a side of the trough of the rotating brush so as to come into contact with the trough and a triangular shape inclined downward from a root toward a tip, wherein the protrusion of the first remover extends from the root to the tip in the axial direction of the rotating brush.

2. The suction tool for a vacuum cleaner according to claim 1, wherein the rotating brush includes a brush removing grip for pulling out and removing the rotating brush in the axial direction, and the dust removing device removes dust adhering to the rotating brush using the first remover when the rotating brush is pulled out by the brush removing grip.

3. The suction tool for a vacuum cleaner according to claim 1, wherein the cleaning body holding portions of the rotating brush protrude from an outer peripheral surface of the cylindrical base.

4. The suction tool for a vacuum cleaner according to claim 3, wherein the protrusion of the first remover has a largest diameter at the root, has a decreasing width in the axial direction of the rotating brush, has a surface that faces the rotating brush and forms substantially the same shape as the trough with a certain space, and has a conical shape inclined toward the tip circumferentially of the rotation axis.

5. The suction tool for a vacuum cleaner according to claim 1, wherein the dust removing device includes a second remover that at least comes into contact with tips of the cleaning bodies of the rotating brush.

6. The suction tool for a vacuum cleaner according to claim 5, wherein a distance between the second remover and a rotation axis of the rotating brush is larger than a distance between the cleaning body holding portion and the rotation axis of the rotating brush.

7. The suction tool for a vacuum cleaner according to claim 5, wherein a distance between an upper surface of the root of a protrusion of the first remover and the rotation axis of the rotating brush is larger than a distance between the second remover and the rotation axis of the rotating brush.

8. The suction tool for a vacuum cleaner according to claim 7, wherein the second remover includes a protrusion placed correspondingly to the cleaning body, and extending in the axial direction of the rotating brush.

9. The suction tool for a vacuum cleaner according to claim 8, wherein the protrusion of the second remover has an upper surface that faces a side of the cleaning body and is inclined downward from a root toward a tip.

10. The suction tool for a vacuum cleaner according to claim 9, wherein a height of the root of the protrusion of the second remover is smaller than a height of the root of the protrusion of the first remover.

11. The suction tool for a vacuum cleaner according to claim 10, wherein the protrusion of the first remover does not overlap the cylindrical base of the rotating brush in the axial direction.

12. The suction tool for a vacuum cleaner according to claim 1, wherein the dust removing device is rotatably held by a shaft provided in the suction tool, configured so that the rotating brush passes through substantially the center of the dust removing device, and rotated integrally with the rotating brush in operation.

13. The suction tool for a vacuum cleaner according to claim 1, wherein the protrusion of the first remover faces the cylindrical base of the rotating brush in the axial direction of the rotating brush, and fitted in the trough in a circumferential direction.

14. The suction tool for a vacuum cleaner according to claim 1, wherein the dust removing device is provided integrally with or fixed to the suction tool, has an opening through which the rotating brush passes through, and does not rotate in operation.

15. The suction tool for a vacuum cleaner according to claim 1, wherein the dust removing device can remove dust adhering to the rotating brush during operation.

16. The suction tool for a vacuum cleaner according to claim 1, wherein a plurality of dust removing devices are provided.

17. The suction tool for a vacuum cleaner according to claim 16, wherein the plurality of dust removing devices collect dust between adjacent dust removing devices.

* * * * *